US006856224B1

(12) United States Patent
Leupold

(10) Patent No.: US 6,856,224 B1
(45) Date of Patent: Feb. 15, 2005

(54) END CAPS ON HOLLOW MAGNETS

(75) Inventor: Herbert A. Leupold, Eatontown, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/914,781

(22) Filed: Aug. 4, 2004

(51) Int. Cl.[7] ..... H01F 7/02
(52) U.S. Cl. ..... 335/306; 335/304
(58) Field of Search ..... 305/210–214, 305/301–306; 315/5.34, 5.35; 372/2

(56) References Cited

U.S. PATENT DOCUMENTS

| | | | | |
|---|---|---|---|---|
| 4,835,506 A | | 5/1989 | Leupold | |
| 4,839,059 A | * | 6/1989 | Leupold | 335/210 |
| 5,126,713 A | * | 6/1992 | Leupold | 335/304 |
| 5,319,339 A | | 6/1994 | Leupold | |
| 5,337,472 A | | 8/1994 | Leupold | |
| 5,805,044 A | * | 9/1998 | Leupold | 335/306 |

OTHER PUBLICATIONS

H.A. Leupold, "An Overview of Permanent Magnet Design", U.S. Army T.R. SLCET–TR–90–6, Aug. 1990.

* cited by examiner

*Primary Examiner*—Ramon M. Barrera
(74) *Attorney, Agent, or Firm*—Michael Zelenka; George B. Tereschuk

(57) ABSTRACT

A compact permanent magnet structure is provided to produce a uniform magnetic biasing field confined to an internal cavity of a cylindrical magnetic flux source which eliminates the drawbacks, shortcomings, limitations and difficulties associated with an elongated magic ring. The compact permanent magnet structure is composed of a cylindrical magnetic flux source with a cylindrical axis, a hollow central cavity, an inner diameter and a remanence perpendicular to said cylindrical axis. The ends of the cylindrical magnetic flux source are capped by a first magnetic flux source and a second magnetic flux source. The compact permanent magnet structure produces a uniform biasing field by capping the end of the cylindrical magnetic flux source with a hemispheric section of a magic sphere having a cavity diameter and shell axis equivalent to the magic ring. The cylindrical magnetic flux source can be a magic ring and the caps can either be geometric or parametric. A method for producing the uniform magnetic biasing field in a compact permanent magnet structure is also provided.

32 Claims, 3 Drawing Sheets

END CAPS ON HOLLOW MAGNETS

GOVERNMENT INTEREST

The invention described herein may be manufactured, used and licensed by or for the United States of America without the payment to me of any royalties thereon.

FIELD OF THE INVENTION

This invention relates to permanent magnet devices. More particularly, this invention relates to useful devices and methods that eliminate or lessen the effects of transverse fields in the cylindrical cavity of hollow cylindrical magnets.

BACKGROUND OF THE INVENTION

Many devices that employ magnetic fields have heretofore been encumbered by massive solenoids with their equally bulky power supplies. There has been increasing interest in the application of permanent-magnet structures for such uses as electron-beam focusing and biasing fields. The current demand for compact, strong, static magnetic field sources requiring no electrical power supplies has created needs for permanent magnet structures of unusual form. Many of these permanent magnet structures have been developed for electronic beam guidance in millimeter or microwave tubes, for millimeter wave filters, circulators, isolators and strip lines, nuclear magnetic resonance imagers and other similar devices for which a relatively large uniform magnetic field is desired.

Many of these permanent magnet structures provide a relatively high uniform magnetic field and have embodied the principles of a "magic" ring, cylinder, hemisphere sphere. An example of a "magic sphere" or hollow spherical flux source is disclosed in Leupold, U.S. Pat. No. 4,835,506, entitled "Hollow Substantially Hemispherical Permanent Magnet High Field Flux Source," issued May 30, 1989. Methods of making the "magic ring" and "magic sphere" are also disclosed in Leupold, U.S. Pat. No. 5,337,472, entitled "Method of Making Cylindrical and Spherical Permanent Magnet Structures," issued on Aug. 16, 1994. Magnets creating transverse magnetic fields have been disclosed in Leupold, U.S. Pat. No. 5,319,339, entitled "Tubular Structure Having Transverse Magnetic Field With Gradient," all of which are incorporated herein by reference. Particularly promising for such purposes is the configuration based on the hollow cylindrical flux source ("HCFS"), also known as a magic ring, which is a cylindrical permanent-magnet shell offering a magnetization vector that is primarily constant in magnitude and produces a field greater than the remanence of the magnetic material from which it is made.

The magic ring concept and its polygonal approximations have proven useful for applications requiring relatively high transverse fields in tubular working spaces, such as mm/microwave radiation sources and amplifiers. The magic ring has also been particularly useful as a common permanent magnet configuration to confine transverse magnetic fields to cylindrical magnets. For example, see H. A. Leupold and E. Potenziani, *An Overview of Permanent Magnet Design*. U.S. Army T.R. SLCET-TR-90-6, August 1990. However, the magic ring is not without its drawbacks, shortcomings, limitations and difficulties. The magic ring can exhibit field distortions because of end effects, and in order to achieve a fairly uniform biasing field, each end of the ring must be elongated by an amount approximately equal to its structural diameter, so that the central portion of the field which is uniform is long enough for the user's purposes. However, the elongated structure's wastefully long length-to-length ratio, as well as the end regions having the field attenuating because of the significant amounts of wasted space in the structure, causes a number of undesirable increases in a device's mass and bulk, making the elongated magic ring unsuitable for a number of applications.

Thus there has been a long-felt and unsatisfied need for a uniform magnetic field within an internal cavity in a far more compact structure that does not suffer from the drawbacks, shortcomings, limitations and difficulties associated with the elongated magic ring. Up until now, there is no compact magnetic structure that also provides the much-needed magnetic field uniformity. The present invention solves the long-felt need for field uniformity within a more compact structure by providing a permanent magnetic structure that produces a uniform biasing field by capping the end of the magic ring with a hemispheric section of a magic sphere having a cavity diameter and shell axis equivalent to the magic ring. In accordance with the present invention, a permanent magnetic structure with a capped end of a magic ring and a hemispheric magic sphere section, as further described herein, produces a magnetic field on an axis of the magic ring's end because the magic sphere caps now produce a transverse magnetic field within the structure's hollow cavity.

SUMMARY OF THE INVENTION

Accordingly, it is a primary object of the present invention to achieve a highly uniform biasing field within a very compact magnetic structure and a high, uniform magnetic field that is undistorted because of end effects.

It is yet another object of the present invention to achieve a highly effective and uniform magnetic field within a magic ring by capping each end with a hemispheric section of a magic sphere having a cavity diameter and shell axis equivalent to the magic ring.

It is still a further object of the present invention to achieve a highly effective and uniform magnetic field within a magic ring by capping the end of a magic ring with a hemispheric section of a magic sphere having a cavity diameter and shell axis equivalent to the magic ring to produce magnetic field on an axis of the magic ring's end because the magic sphere caps now produce a transverse magnetic field within the structure's hollow cavity.

These and other objects and advantages are achieved in accordance with the permanent magnetic structure producing a uniform and undistorted biasing magnetic field, comprising a magic ring structure with its ends advantageously capped with a portion of a magic sphere having both a cavity diameter and shell axis equivalent to the magic ring in order to produce a transverse magnetic field. The capped magic ring structure of the present invention achieves a compact, uniform magnetic flux source having a transverse magnetic field without suffering from any of the disadvantages, shortcomings, limitations and difficulties previously associated with the elongated magic ring and other prior art devices.

FIG. 1 illustrates both the ideal and actual hollow cylindrical flux source ("HCFS"), or magic ring, structures that are useful in understanding the present invention. The ideal structure 5 depicts the magnetization orientation of the magic ring, while the actual structure 10 illustrates the construction of a magic ring approximated by joining 16 uniformly magnetized segments in order to achieve the generally inward, circular magnetization orientation of the ideal structure. Similarly, the magic ring may also be constructed in an octagonal configuration.

The magic ring structure is a cylindrical shell of permanent magnet material in which the direction of magnetization, $\gamma$, will vary, as depicted in FIG. 1 according to the formula:

$$\gamma=2\phi$$

where $\phi$ is the azimuthal angle of the cylindrical coordinate system with its origin at the magic ring's center. Such a ring of infinite length, or a length much larger than its diameter, produces a magnetic field, H, in its interior cavity according to the formula:

$$H = Br\ln\left(\frac{r_o}{r_i}\right) \tag{1}$$

where $B_r$ is remanence, and $r_o$ and $r_i$ are the outer and inner radii of the ring, respectively. Theoretically, there is no limit to the magnitude attainable for magnetic field, H. However, because of the logarithmic dependence of H on the outer radius, such a structure would be prohibitively large for magnetic fields much greater than about 2 $B_r$. FIG. 1 shows that the magnetic field begins dropping near the ends of the ring until the field is only about a half as strong as the field at the center of the cavities' cylindrical axis. Due to the tendency of the magnetic field to drop near the ends of the cylindrical ring, in those applications where a uniform field in the magic ring is needed, the ring must be elongated at each end by an amount approximately equal to its structural diameter, so that the central portion, or cavity, where the field is uniform is then long enough for the user's needs. However, the consequence of this elongation process is that significant amounts of wasted space now occupy the structure and the attendant undesirable increases in both mass and bulk. These undesirable consequences of the elongated magic ring have created the long-felt need for a more compact structure with a uniform field within the ring's internal cavity.

The present invention discloses permanent magnetic structures that solve this long-felt and heretofore unsatisfied need for field uniformity within a more compact structure by utilizing a portion of the HCFS, or magic sphere structure depicted in FIG. 2, and a magic ring structure. FIG. 2 illustrates both ideal 15 and actual 20 magic sphere structures. Actual magic sphere structure 20 depicts a group of sections 21 that surround a central cavity 21, with a quarter of the sections 21 removed to reveal central cavity 22 the sake of clarity. A solution to the long-felt need for a more compact magnetic structure providing a uniform magnetic field is suggested by considering the ideal 15 and actual 20 magic sphere structures, each having a cavity diameter and shell with the same dimensions as the FIG. 1 magic ring under consideration. To produce a magnetic field on axis at the end of FIG. 1 magic ring 10, one can supply the missing half-field by advantageously capping the end of the FIG. 1 magic ring with a FIG. 2 magic half sphere. Since the hemispheric magic sphere produces a transverse magnetic field at the juncture of:

$$H_s = \left(\frac{1}{2}\right)\frac{4}{3}(B_r)_s\ln\left(\frac{r_o}{r_i}\right) \tag{2}$$

and the magic ring produces at that point a field of only:

$$H_c = \frac{1}{2}(B_r)_c\ln\left(\frac{r_o}{r_i}\right). \tag{3}$$

it is clear that the remanence, $B_r$, of the sphere must be reduced so that:

$$(B_r)_s = \frac{3}{4}(B_r)_c \tag{4}$$

Thus, the $H_S$ and $H_C$ of the preceding equations (2 and 3) are equal with the sphere and ring each contributing one half of the desired field. These and other objects, advantages and features will become readily apparent in view of the drawings and more detailed description.

DETAILED DESCRIPTION OF THE DRAWINGS

In order to satisfy the long-standing need for a uniform magnetic field within an internal cavity in a compact magnetic structure without suffering from the drawbacks, shortcomings, limitations and difficulties associated with prior art devices, the present invention provides compact magnetic structures that provide the much-needed magnetic field uniformity by capping the end of the magic ring with a hemispheric section of a magic sphere having a cavity diameter and shell axis equivalent to the magic ring. The permanent magnetic structures of the present invention further comprise a compact parametric capped permanent magic ring structure and a compact geometric capped permanent magic ring structure without suffering the drawbacks, shortcomings, limitations and difficulties associated with prior art devices.

In accordance with the present invention, it is now possible to configure magic ring structures in such a way that the outer radius of the sphere can be reduced so that H and $H_C$ in equations (2) and (3) above are equal despite the remanence values of the sphere and the cylinder being the same. This approach will save weight, but will also require additional tooling, because if the diameters of the sphere and the cylinder are the same, the component rings of each structure can be made with the same die, although parts of the sphere need to be subjected to additional treatment in either case. See the inventor's U.S. Pat. No. 5,337,472, entitled "Method of Making Cylindrical and Spherical Permanent Magnet Structures," which is also incorporated herein by reference.

Figure 1:
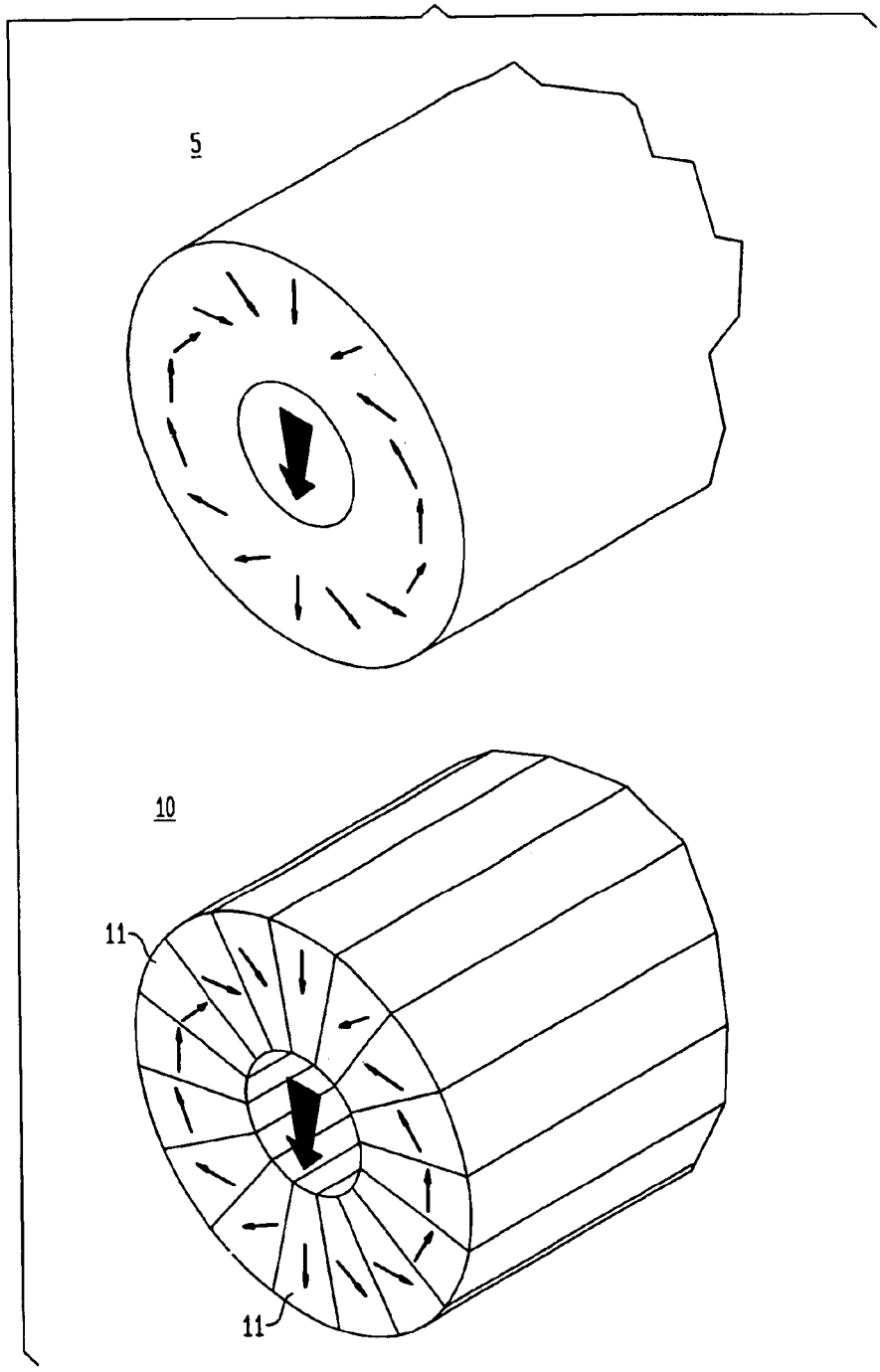
FIG. 1 depicts ideal and actual HCFS structures.
Figure 2:
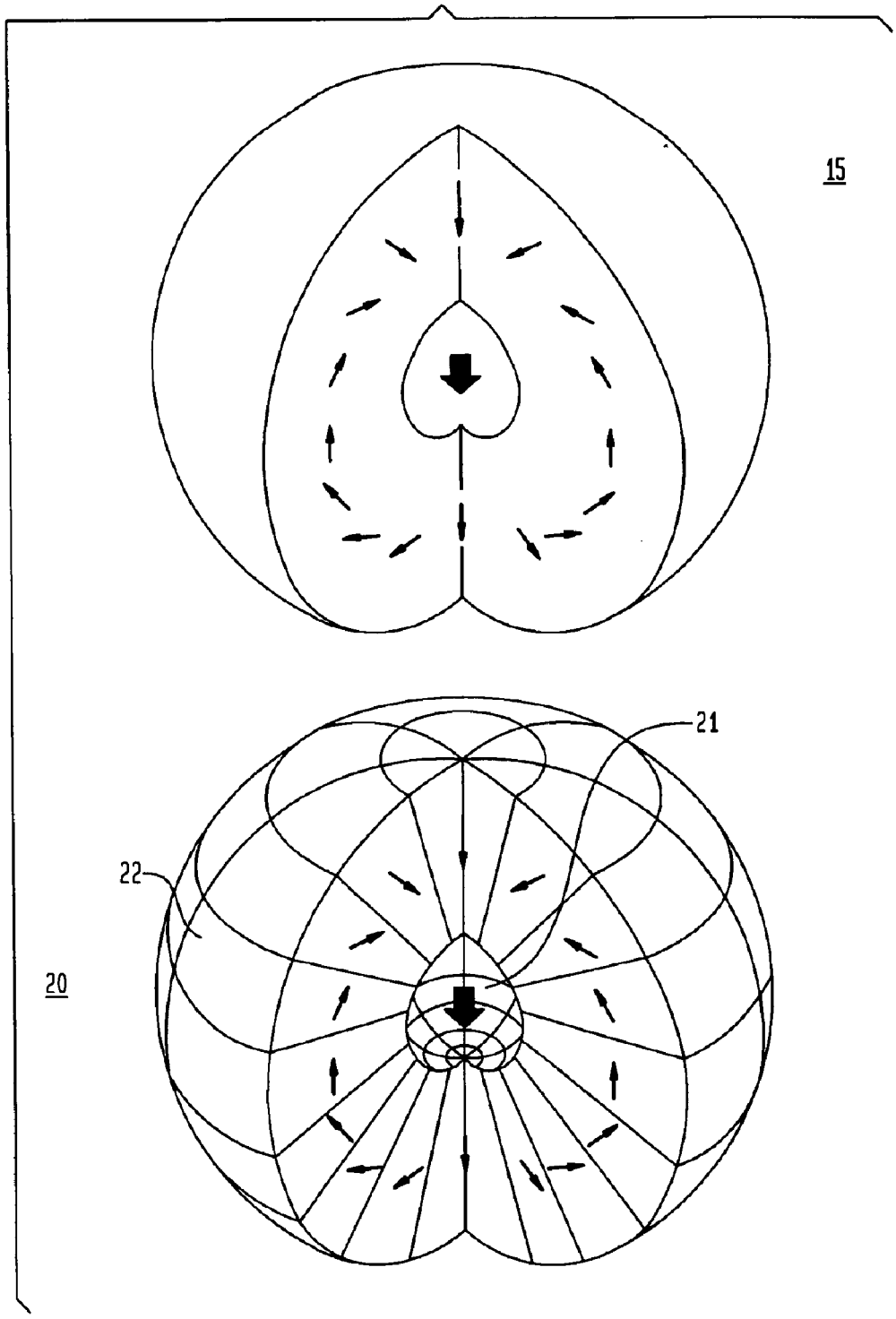
FIG. 2 depicts ideal and actual magic ring structures.
Figure 3:
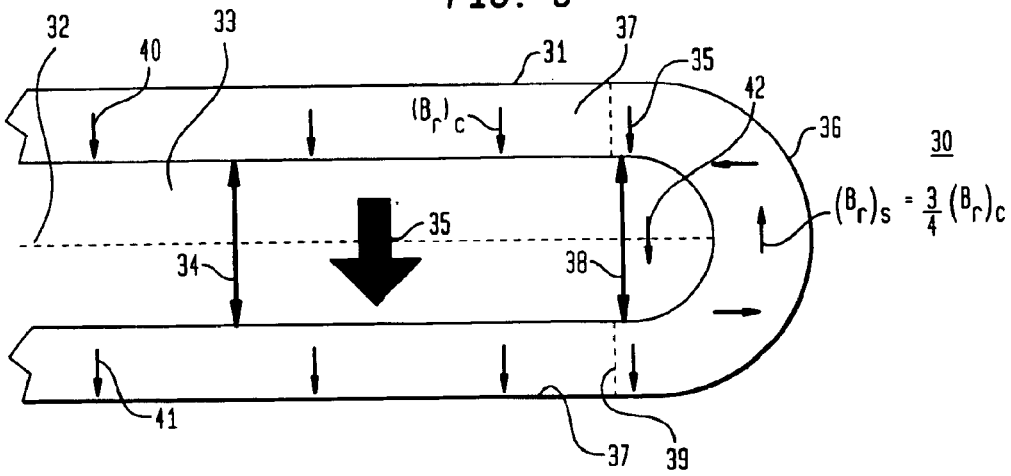
FIG. 3 illustrates a parametric capped magic ring embodiment of the present invention.

FIG. 3 depicts a parametric capped permanent magic ring structure 30 producing a uniform biasing field, comprising a cylindrical magnetic flux source 31 with a remanence indicated by small arrows 40 and 41 and having a cylindrical axis 32, a hollow central cavity 33 and an inner diameter 34. The cylindrical magnetic flux source 31 produces a uniform biasing magnetic field 35 perpendicular to the cylindrical axis 32. The cylindrical magnetic flux source 31 is a magic ring structure composed of a number of magnetic segments which not shown in FIG. 3 for the sake of clarity. A first magnetic flux source 36 fully caps a first end 37 of the cylindrical magnetic flux source 31, with the first magnetic flux source 36 having a first cavity diameter 38. Broken line 39 represents the boundary between the cylindrical magnetic flux source 31 and the first magnetic flux source 36. A second magnetic flux source capping a second end of the cylindrical magnetic flux source 31 is not shown in the drawing. The inner diameter 34, which is shown left of large arrow 35, is equivalent to the first cavity diameter 38 and the second cavity diameter. The first and second cap magnetic flux sources each create a transverse magnetic field illustrated by small arrow 42 to help produce the uniform biasing magnetic field 35 within the parametric capped permanent magic ring structure 30 of the present invention. The cylindrical magnetic flux source 31 could be a magic ring structure composed of a number of magnetic segments which not shown in FIG. 3 for the sake of clarity and the first and second magnetic flux sources are composed of magic sphere segments with the appropriate dimensions.

Variations of the parametric capped permanent magic ring structure 30 include 13 the cylindrical magnetic flux source 31 being composed of a plurality of circular magnetic segments, the cylindrical magnetic flux source 31 being a magic ring, the first magnetic flux source 36 being composed of a plurality of magic sphere segments and the second magnetic flux source being composed of said plurality of magic sphere segments.

Figure 4:
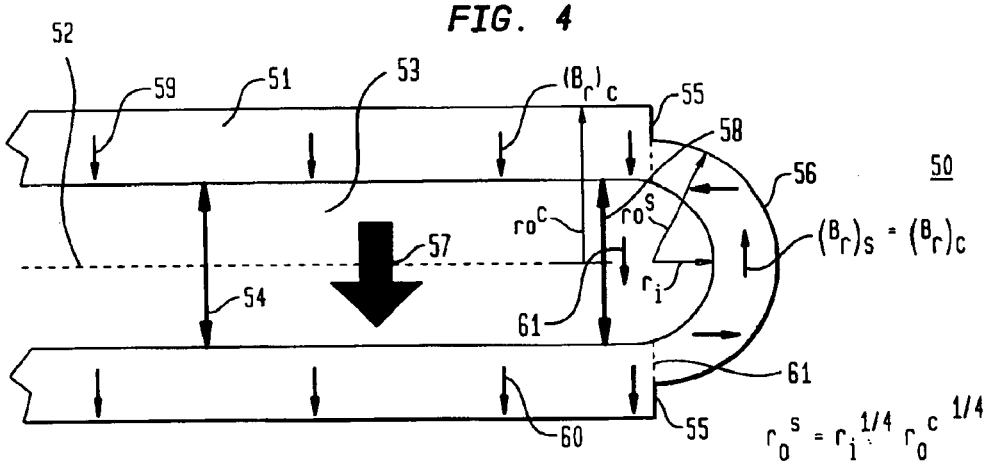
FIG. 4 illustrates a geometric capped magic ring embodiment of the present invention.

FIG. 4 illustrates a compact geometric capped magic ring embodiment 50 producing a uniform biasing field, comprising a cylindrical magnetic flux source 51 with remanence indicated by small arrows 59 and 60 and having a cylindrical axis 52, a hollow central cavity 53, an inner diameter 54, a first end 55 and a first magnetic flux cap 56. The cylindrical magnetic flux source 51 further comprising a transverse magnetic field 57 that is perpendicular to the cylindrical axis 52. The first magnetic flux cap 56 partially caps the first end 55 of the cylindrical magnetic flux source 51, with the magnetic flux cap 56 having a first cavity diameter 54. Broken line 61 represents the boundary between the cylindrical magnetic flux source 51 and the first magnetic flux cap 56. A second magnetic flux cap capping a second end of the magnetic flux source 51 and having a second cavity diameter is not shown in the drawing. The inner diameter 54 is equal to the first cavity diameter 58 and the second cavity diameter. The first and second cap magnetic flux sources each create a cap transverse magnetic field illustrated by small arrow 61 confining the transverse magnetic field within the hollow central cavity 53 to produce a uniform biasing magnetic field 57 within the geometric capped magic ring structure 50 of the present invention.

The compact geometric capped magic ring structure 50 tends to be lighter than the parametric capped permanent magic ring structure 30. The parametric capped permanent magic ring structure 30 is also somewhat easier to fabricate than the geometric capped magic ring structure 50. The cylindrical magnetic flux source 31 could be a magic ring structure composed of a number of magnetic segments with the appropriate dimensions, which are not shown in FIG. 3 for the sake of clarity. Similarly, the first and second magnetic flux sources may also be composed of magic sphere segments with the appropriate dimensions and they are not depicted in the figures for the sake of clarity. The variations to the parametric capped permanent magic ring structure 30 may also be applicable to the geometric capped magic ring structure 50.

It is also noted that the addition of the hemispherical caps of the present invention to the ends of the cylinder will result in correct fields at the junctures, but this configuration will not completely accomplish the correct field within the cylinder because of the fall-off of the spherical field with distances from the juncture are not quite the same as the rise in the cylindrical field over the same distance. Therefore, the sum of the hemispherical and cylindrical fields will not add up to exactly the same field at all points. For most purposes this variation is insignificant, however, where a more precise approximation is needed, this can be effected through the variation of the cylindrical field by slight variations of the remanence value along the cylindrical axis similar to the methods disclosed in the inventor's U.S. Pat. No. 5,319,339, entitled "Tubular Structure Having Transverse Magnetic Field With Gradient," which is also incorporated herein by reference. Based on this, it should therefore be possible to cancel the mismatch between the hemisphere and cylinder by an appropriate manipulation of the remanence value as well as the outer radii of the cylinder, if needed.

It is also noted that results of this invention may also be accomplished through the use of polygonal and polyhedral approximations to the magic rings and magic spheres, respectively.

The present invention also encompasses a method for producing a uniform magnetic biasing field in a compact permanent magnet structure, comprising the steps of forming a cylindrical magnetic flux source with a cylindrical axis, a hollow central cavity, an inner diameter and a remanence perpendicular to said cylindrical axis; capping a first end of the cylindrical magnetic flux source with a first magnetic flux source, the first magnetic flux source having a first cavity diameter; capping a second end of the cylindrical magnetic flux source with a second magnetic flux source, the second magnetic flux source having a second cavity diameter; dimensioning the inner diameter to be equivalent to the first cavity diameter and the second cavity diameter and generating a transverse magnetic field from the first magnetic flux source and the second magnetic flux source, the transverse magnetic field assisting in producing the uniform biasing magnetic field perpendicular to the cylindrical axis and confined within the hollow central cavity. The variations to the parametric capped permanent magic ring structure 30, geometric capped magic ring structure 50 may also be applicable to the method for producing a uniform magnetic biasing field in a compact permanent magnet structure.

It is to be further understood that other features and modifications to the foregoing detailed description are within the contemplation of the present invention, which is not limited by this detailed description. Those skilled in the art will readily appreciate that any number of configurations of the present invention and numerous modifications and combinations of materials, components, geometries, arrangements and dimensions can achieve the results described herein, without departing from the spirit and scope of this invention. Accordingly, the present invention should not be limited by the foregoing description, but only by the appended claims.

What I claim is:

1. A compact permanent magnet structure producing a uniform magnetic biasing field, comprising:

a cylindrical magnetic flux source having a cylindrical axis, a hollow central cavity, an inner diameter and a remanence perpendicular to said cylindrical axis;

a first magnetic flux source, having a first cavity diameter, caps a first end of said cylindrical magnetic flux source;

a second magnetic flux source, having a second cavity diameter, caps a second end of said cylindrical magnetic flux source;

said inner diameter being equivalent to said first cavity diameter and said second cavity diameter; and said first magnetic flux source and said second magnetic flux source each generating a transverse magnetic field to assist in producing said uniform biasing magnetic field perpendicular to said cylindrical axis and confined within said hollow central cavity.

2. The compact permanent magnet structure producing said uniform magnetic biasing field, as recited in claim 1, further comprising said cylindrical magnetic flux source being composed of a plurality of circular magnetic segments.

3. The compact permanent magnet structure producing said uniform magnetic biasing field, as recited in claim 2, further comprising said cylindrical magnetic flux source being a magic ring.

4. The compact permanent magnet structure producing said uniform magnetic biasing field, as recited in claim 3, further comprising said first magnetic flux source being composed of a plurality of magic sphere segments.

5. The compact permanent magnet structure producing said uniform magnetic biasing field, as recited in claim 4, further comprising said second magnetic flux source being composed of said plurality of magic sphere segments.

6. The compact permanent magnet structure producing said uniform magnetic biasing field, as recited in claim 5, further comprising said first end being fully capped by said first magnetic flux source.

7. The compact permanent magnet structure producing said uniform magnetic biasing field, as recited in claim 6, further comprising said second end being fully capped by said second magnetic flux source.

8. The compact permanent magnet structure producing said uniform magnetic biasing field, as recited in claim 7, wherein said structure is a parametric capped permanent magic ring structure.

9. The compact permanent magnet structure producing said uniform magnetic biasing field, as recited in claim 5, further comprising said first end being partially capped by said first magnetic flux source.

10. The compact permanent magnet structure producing said uniform magnetic biasing field, as recited in claim 9, further comprising said second end being partially capped by said second magnetic flux source.

11. The compact permanent magnet structure producing said uniform magnetic biasing field, as recited in claim 10, wherein said structure is a geometric capped magic ring structure.

12. A compact parametric capped permanent magic ring structure producing a uniform magnetic biasing field, comprising:

a cylindrical magnetic flux source having a cylindrical axis, a hollow central cavity, an inner diameter and a remanence perpendicular to said cylindrical axis;

a first magnetic flux source, having a first cavity diameter, fully caps a first end of said cylindrical magnetic flux source;

a second magnetic flux source, having a second cavity diameter, fully caps a second end of said cylindrical magnetic flux source;

said inner diameter being equivalent to said first cavity diameter and said second cavity diameter; and said first magnetic flux source and said second magnetic flux source each generating a transverse magnetic field to assist in producing said uniform biasing magnetic field perpendicular to said cylindrical axis and confined within said hollow central cavity.

13. The compact parametric capped permanent magnet structure producing said uniform magnetic biasing field, as recited in claim 12, further comprising said cylindrical magnetic flux source being composed of a plurality of circular magnetic segments.

14. The compact parametric capped permanent magnet structure producing said uniform magnetic biasing field, as recited in claim 13, further comprising said cylindrical magnetic flux source being a magic ring.

15. The compact parametric capped permanent magnet structure producing said uniform magnetic biasing field, as recited in claim 14, further comprising said first magnetic flux source being composed of a plurality of magic sphere segments.

16. The compact parametric capped permanent magnet structure producing said uniform magnetic biasing field, as recited in claim 15, further comprising said second magnetic flux source being composed of said plurality of magic sphere segments.

17. A compact geometric capped permanent magnet structure producing a uniform magnetic biasing field, comprising:

a cylindrical magnetic flux source having a cylindrical axis, a hollow central cavity, an inner diameter and a remanence perpendicular to said cylindrical axis;

a first magnetic flux source, having a first cavity diameter, partially caps a first end of said cylindrical magnetic flux source;

a second magnetic flux source, having a second cavity diameter, partially caps a second end of said cylindrical magnetic flux source;

said inner diameter being equivalent to said first cavity diameter and said second cavity diameter; and said first magnetic flux source and said second magnetic flux source each generating a transverse magnetic field to assist in producing said uniform biasing magnetic field perpendicular to said cylindrical axis and confined within said hollow central cavity.

18. The compact geometric capped permanent magnet structure producing said uniform magnetic biasing field, as recited in claim 17, further comprising said cylindrical magnetic flux source being composed of a plurality of circular magnetic segments.

19. The compact geometric capped permanent magnet structure producing said uniform magnetic biasing field, as recited in claim 18, further comprising said cylindrical magnetic flux source being a magic ring.

20. The compact geometric capped permanent magnet structure producing said uniform magnetic biasing field, as recited in claim 19, further comprising said first magnetic flux source being composed of a plurality of magic sphere segments.

21. The compact geometric capped permanent magnet structure producing said uniform magnetic biasing field, as recited in claim 20, further comprising said second magnetic flux source being composed of said plurality of magic sphere segments.

22. A method for producing a uniform magnetic biasing field in a compact permanent magnet structure, comprising the steps of:

forming a cylindrical magnetic flux source having a cylindrical axis, a hollow central cavity, an inner diameter and a remanence perpendicular to said cylindrical axis;

capping a first end of said cylindrical magnetic flux source with a first magnetic flux source, said first magnetic flux source having a first cavity diameter;

capping a second end of said cylindrical magnetic flux source with a second magnetic flux source, said second magnetic flux source having a second cavity diameter;

dimensioning said inner diameter to be equivalent to said first cavity diameter and said second cavity diameter; and generating a transverse magnetic field from said first magnetic flux source and said second magnetic flux source, said transverse magnetic field assisting in producing said uniform biasing magnetic field perpendicular to said cylindrical axis and confined within said hollow central cavity.

23. The method for producing the uniform magnetic biasing field in said compact permanent magnet structure, as recited in claim 22, further comprising the step of forming said cylindrical magnetic flux source from a plurality of circular magnetic segments.

24. The method for producing the uniform magnetic biasing field in said compact permanent magnet structure, as recited in claim 23, wherein said cylindrical magnetic flux source is a magic ring.

25. The method for producing the uniform magnetic biasing field in said compact permanent magnet structure, as recited in claim 24, further comprising the step of forming said first magnetic flux source from a plurality of magic sphere segments.

26. The method for producing the uniform magnetic biasing field in said compact permanent magnet structure, as recited in claim 25, further comprising the step of forming said second magnetic flux source from said plurality of magic sphere segments.

27. The method for producing the uniform magnetic biasing field in said compact permanent magnet structure, as recited in claim 26, further comprising the step of fully capping said first end with said first magnetic flux source.

28. The method for producing the uniform magnetic biasing field in said compact permanent magnet structure, as recited in claim 27, further comprising the step of fully capping said second end with said second magnetic flux source.

29. The method for producing the uniform magnetic biasing field in said compact permanent magnet structure, as recited in claim 28, wherein said structure is a parametric capped permanent magic ring structure.

30. The method for producing the uniform magnetic biasing field in said compact permanent magnet structure, as recited in claim 26, further comprising the step of partially capping said first end with said first magnetic flux source.

31. The method for producing the uniform magnetic biasing field in said compact permanent magnet structure, as recited in claim 30, further comprising the step of partially capping said second end with said second magnetic flux source.

32. The method for producing the uniform magnetic biasing field in said compact permanent magnet structure, as recited in claim 31, wherein said structure is a geometric capped magic ring structure.

* * * * *